United States Patent [19]

Bruni

[11] 4,030,599

[45] June 21, 1977

[54] SPADE BIT HOLDER

[76] Inventor: Rudolph C. Bruni, 409 Walnut St., Point Marion, Pa. 15474

[22] Filed: July 19, 1976

[21] Appl. No.: 706,260

[52] U.S. Cl. ..... 206/379; 206/214; 211/60 T; 211/69

[51] Int. Cl.[2] ..... B65D 85/20; A47F 7/03

[58] Field of Search ..... 206/379, 371, 214; 211/69, 69.1, 62, 64, 69.5, 67, 68, 65, 69.6, 60 M, 60 T, 84, 76, 83, 4; 312/206, 207

[56] References Cited

UNITED STATES PATENTS

| | | | |
|---|---|---|---|
| 369,911 | 9/1887 | Brennan | 211/65 X |
| 400,288 | 3/1889 | Bartlett | 206/379 |
| 1,350,118 | 8/1920 | Spelling | 206/214 |
| 1,409,256 | 3/1922 | Spelling | 206/214 |
| 2,572,807 | 10/1951 | Hook | 211/65 |
| 2,589,234 | 3/1952 | Drohman | 206/379 |
| 2,962,154 | 11/1960 | Falk | 206/379 |

*Primary Examiner*—Robert S. Ward, Jr.
*Attorney, Agent, or Firm*—Robert D. Farkas

[57] ABSTRACT

A container for drills comprises spaced side members interconnected by means of a base and a top and bottom rack, each rack having a plurality of holes, the holes in the top rack being aligned over the holes in the bottom rack, the racks extending between the side members, a swing-away cover is connected to the top of one side piece by means of a pivot screw and extends across the container to the top of the other side piece where it is fastened by means of a removable fastener such that when unfastened the cover can be swung-away and the drills removed from the container.

5 Claims, 4 Drawing Figures

SPADE BIT HOLDER

BACKGROUND OF THE INVENTION

This invention relates to a container for the storage of drills and more particularly to a container for holding and storing various size wood drills.

The present invention affords a drill container which can be made inexpensively and which allows not only easy access to the drills but in open so that one can readily see the drills contained therein.

SUMMARY OF THE INVENTION

A container for drills comprises spaced side members interconnected by means of a base member, top and bottom rack having a plurality of holes for supporting said drills each hole in said top rack being aligned over a hole in said bottom rack, said top and bottom racks extending between and fastened to said members, swing-away cover pivotably secured to the top of one side member by means of a pivot screw and extending to the top of the other side member, and removable cover locking means at said other side member for locking or unlocking said swing-away cover.

DETAILED DESCRIPTION OF THE PREFERRED EMBODIMENT

Figure 1:
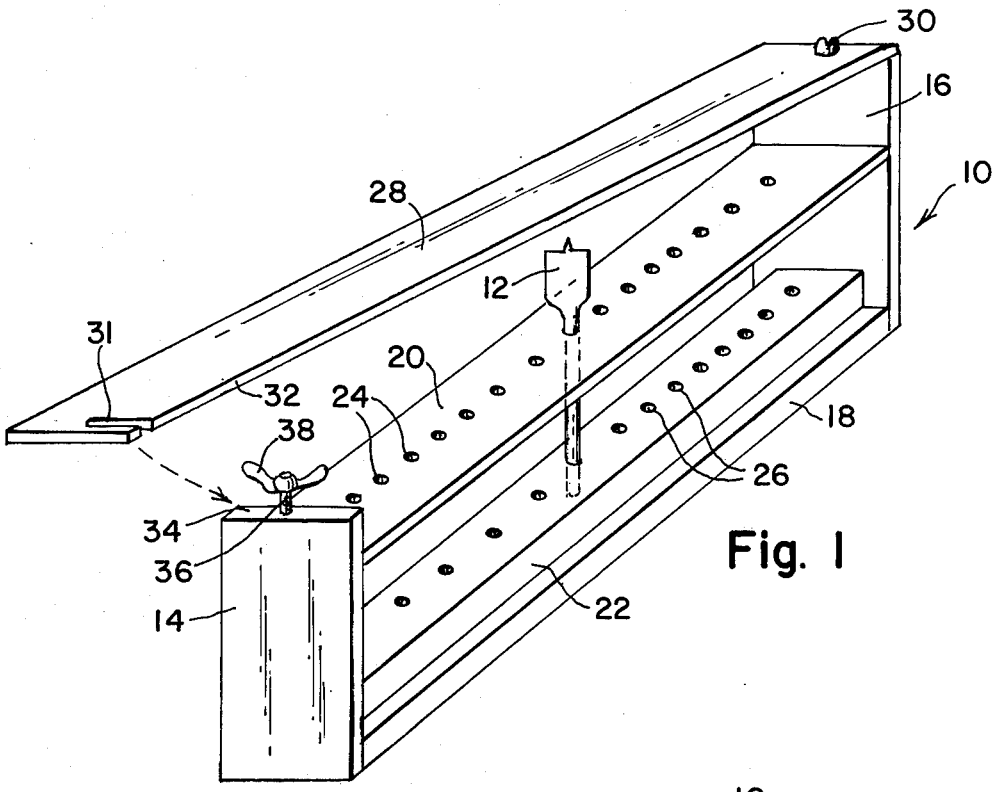
FIG. 1 is an isometric view of an embodiment of the invention.
Figure 2:
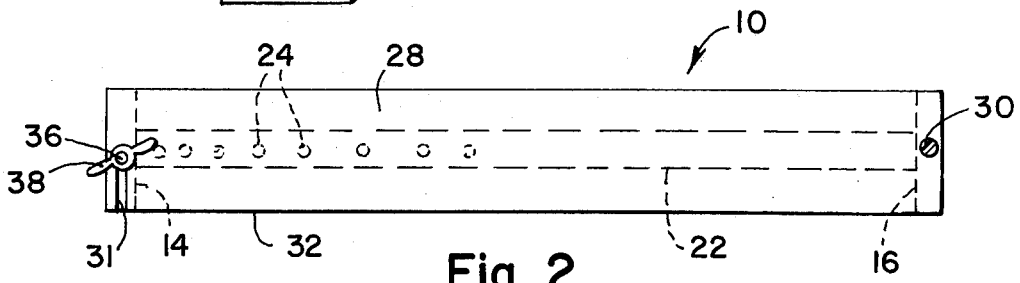
FIG. 2. is a top elevational view of the embodiment shown in FIG. 1.

Referring to FIG. 1 and 2 there is shown a drill container 10. The container 10 is essentially rectangular, though other shapes can be employed, if desired. The container 10 is capable of holding drills 12 in closely spaced relationship yet provides ready access and observation of the drills contained therein. The container 10 includes two spaced rectangular end (or side) support members 14 and 16 and a rectangular base member 18 extending between and fastened to the side support members 14 and 16. Extending between support members 14 and 16 are drill holding means consisting of a top rack 20 and a bottom rack 22. The ends of the racks 20 and 22 are fastened to the support members 14 and 16. The racks 20 and 22 are provided with a plurality of apertures 24 and 26 respectively, the apertures 24 of the top rack 20 being aligned over corresponding apertures 26 of the bottom rack 22. The apertures 24 and 26 are of a size sufficient to contain the shaft of the drills to be stored in the container 10. It should be understood that the base member 18 can be formed with apertures such that it acts as the bottom rack 22. The top rack 20 can be parallel to the bottom rack 22 as shown, or alternatively it can be mounted on an angle to the bottom rack 22. The distance between corresponding apertures 24 and 26 must be such that the drill stems to fit therethrough is at least as long as said distance.

Side support members 14 and 16 extend upwardly beyond the top rack 20 a distance greater than the distance which the longest drill extends above the rack 20. A top member or cover 28 is pivotally secured to the top edge of support member 16 by means of a pivot screw 30 such that the cover can swing-away in a horizontal plane so as to uncover the drills in the container 10. The cover 28 extends across the top of the container to the top edge of support member 14. Means are provided for locking the cover 28 in its closed position for storing the drills.

The locking means shown in FIG. 1 consists of a slot 31 extending from the front edge 32 of cover 28 rearwardly to about the center of cover 28 and aligned with the center of the top edge 34 of side support 14, and a threaded bolt 36 extending from the center of the top edge 34 of side support 14 such that the bolt 36 fits within the slot 31 when the cover 28 is swung into a closed position. A wing nut 38 is provided on bolt 36 for locking the cover 28 in place.

Figure 3:
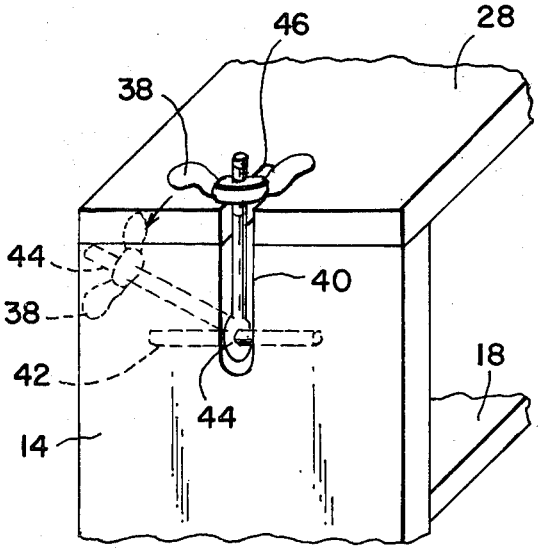
FIG. 3 is a partial perspective view of an alternative cover securing means.

An alternative locking device is shown in FIG. 3. In this embodiment, a vertical slot 40 extends downwardly from the top center portion of side support member 14. A pin 42 is fastened to the support member 14 across slot 40. An eye bolt 44 is provided with the pin 42 going through the eye of the bolt 44 so as to allow rotation of the eye bolt 44 about the pin 42. A corresponding slot 46 is provided cover 28 and a wing nut 38 is provided for locking the cover 28 in position. In operation of this embodiment, the wing nut 38 is loosened and the eye bolt rotated away from the slots 40 and 46 and the cover is then free to swing open.

Figure 4:
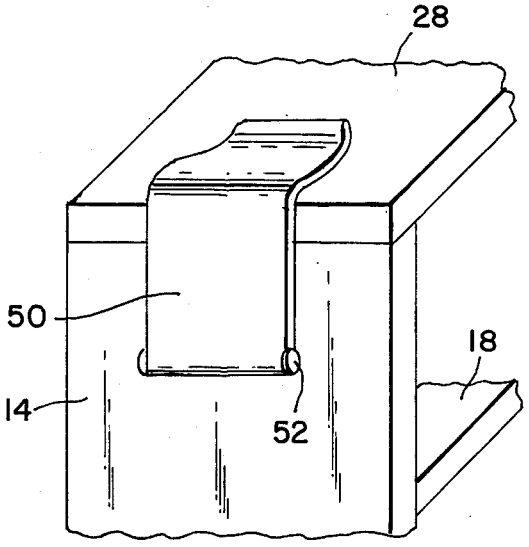
FIG. 4 is a partial perspective view of still another cover securing means.

Another alternative locking means is shown with reference to FIG. 4. Here a spring clip 50 is mounted on the outside surface of support member 14 by a hinge or rotatable mounting means 52. The spring clip 50 clamps the cover 28 in position and when the clip 50 is rotated so as to remove it from the cover 28, the cover can be swung away. The clip can be formed of spring steel or high impact plastic.

It should be noted that like or similar parts are represented by the same numerals in each of the FIGS.

The novel container can be made inexpensively from plastic materials or, if desired, from wood or metal.

I claim:

1. A container for drills comprising spaced side members interconnected by means of a base member, top and bottom racks having a plurality of holes for supporting said drills, each hole in said top rack being aligned over a hole in said bottom rack, said top and bottom racks extending between and fastened to said side members, a swing-away cover pivotably secured to the top of one side member by means of a pivot screw and extending to the top of the other side member, and removable cover locking means at said other side member for locking or unlocking said swing-away cover.

2. The container recited in claim 1 wherein said bottom rack and base consists of one integral piece.

3. The container recited in claim 1 wherein said cover locking means consists of a bolt extending from the top edge of said other side member which fits within a slot in said cover, said slot extending rearwardly from the front edge of said cover and a wing nut on said bolt.

4. The container recited in claim 1 wherein said cover locking means consists of a hinged spring clip mounted on said other side member.

5. The container recited in claim 1 wherein said other side member is provided with a slot having a pin near the base thereof and an eye bolt said pin running through the eye of said eye bolt, a wing nut on said bolt and a corresponding slot in said cover.

* * * * *